US005996911A

United States Patent [19]

Gesk et al.

[11] Patent Number: 5,996,911

[45] Date of Patent: Dec. 7, 1999

[54] ELECTROMAGNETICALLY ACTUATED VALVE

[75] Inventors: Markus Gesk, Karlsbad; Norbert Keim, Löchgau; Joachim Stilling, Fellbach, all of Germany

[73] Assignee: Robert Bosch GmbH, Stuttgart, Germany

[21] Appl. No.: 09/125,185

[22] PCT Filed: Oct. 18, 1997

[86] PCT No.: PCT/DE97/02406

§ 371 Date: Aug. 12, 1998

§ 102(e) Date: Aug. 12, 1998

[87] PCT Pub. No.: WO98/28537

PCT Pub. Date: Jul. 2, 1998

[30] Foreign Application Priority Data

Dec. 24, 1996 [DE] Germany ..... 196 54 322

[51] Int. Cl.[6] ..... B05B 1/30

[52] U.S. Cl. ..... 239/585.1; 251/129.15; 251/129.21; 335/255

[58] Field of Search ..... 239/585.1; 251/129.01, 251/129.15, 129.21, 129.22; 335/251, 255, 262, 277, 258

[56] References Cited

U.S. PATENT DOCUMENTS

| | | | |
|---|---|---|---|
| 4,527,744 | 7/1985 | Hafner et al. | 239/585.3 |
| 4,875,658 | 10/1989 | Asai | 239/585.5 |
| 5,036,885 | 8/1991 | Miura | 251/129.15 |
| 5,732,888 | 3/1998 | Maier et al. | 239/585.1 |
| 5,749,527 | 5/1998 | Fujikawa et al. | 239/585.3 |
| 5,769,391 | 6/1998 | Noller et al. | 251/129.21 |

FOREIGN PATENT DOCUMENTS

| | | | |
|---|---|---|---|
| 0 536 773 | 4/1993 | European Pat. Off. . | |
| 0604915 | 7/1994 | European Pat. Off. | 239/585.1 |
| 29 42 928 | 5/1981 | Germany . | |
| 44 21 935 | 6/1995 | Germany . | |
| 0050285 | 3/1984 | Japan | 251/129.15 |
| 0079860 | 4/1986 | Japan | 239/585.3 |
| 0215175 | 9/1987 | Japan | 251/129.01 |

*Primary Examiner*—Andres Kashnikow
*Assistant Examiner*—Dinh Q. Nguyen
*Attorney, Agent, or Firm*—Kenyon & Kenyon

[57] ABSTRACT

A fuel injection valve for use in fuel injection systems of compressed-mixture, externally ignited internal combustion engines has a core provided with a wear-resistant layer that has a greater layer thickness than a layer thickness of a wear-resistant layer of an armature facing the core. This greater layer thickness is present at least in an immediate contact area between the core and the armature.

6 Claims, 2 Drawing Sheets

ELECTROMAGNETICALLY ACTUATED VALVE

BACKGROUND INFORMATION

The present invention relates to an electromagnetically actuated valve. Several electromagnetically actuated valves, in particular fuel injection valves, are known where components subject to wear are provided with wear-resistant coatings.

German Published Patent Application No. 29 42 928 describes the application of wear-resistant diamagnetic material coatings on parts subject to wear, such as armatures and nozzle bodies. These coatings, applied in accurately dimensioned layer thicknesses, are used to limit the stroke of the valve, thereby minimizing the effect of residual magnetism on the movable parts of the fuel injection valve.

European Published Patent Application No. 0 536 773 also describes a fuel injection valve where a hard metal coating is applied by electroplating to the armature of its cylindrical peripheral surface and annular stop surface. This coating, made of chromium or nickel, has a thickness of 15 to 25 $\mu$m, for example. As a result of electroplating, a slightly tapered layer thickness distribution is formed with a minimally thicker layer achieved at the outer edges. The layer thickness distribution of coatings formed by electroplating is physically predefined and can barely be influenced.

SUMMARY OF THE INVENTION

The valve according to the present invention has the advantage that a cost-effective stop region is created in a simple manner. According to the present invention, in which the wear-protection layer applied on the stationary core is thicker than the wear-protection layer applied on the axially moving armature, it is also possible to increase the magnetic force of the electromagnetic circuit of the valve. Since in the case of electroplated layers leakage is reduced at smaller set values of the layer thickness, smaller effective residual air gap fluctuations occur in the core/armature area. Thus, the fluctuations of the injected fuel amount $q_{dyn}$ are advantageously reduced, while the minimum operate voltage values are increased.

Wear on the movable armature is considerably less than on the stationary core, and thus a much thinner wear protection layer can be applied to the armature without affecting the quality, which results in a non-negligible coating material savings. Furthermore, coating times are advantageously reduced, in particular when coating the armature. Material savings result in cost reduction, which is further enhanced by the reduced disposal costs for the electroplating baths.

Another advantage results from the reduced scatter of the armature diameter, which favorably affects the wear characteristics due to the resulting reduced guidance play.

DETAILED DESCRIPTION

Figure 1:
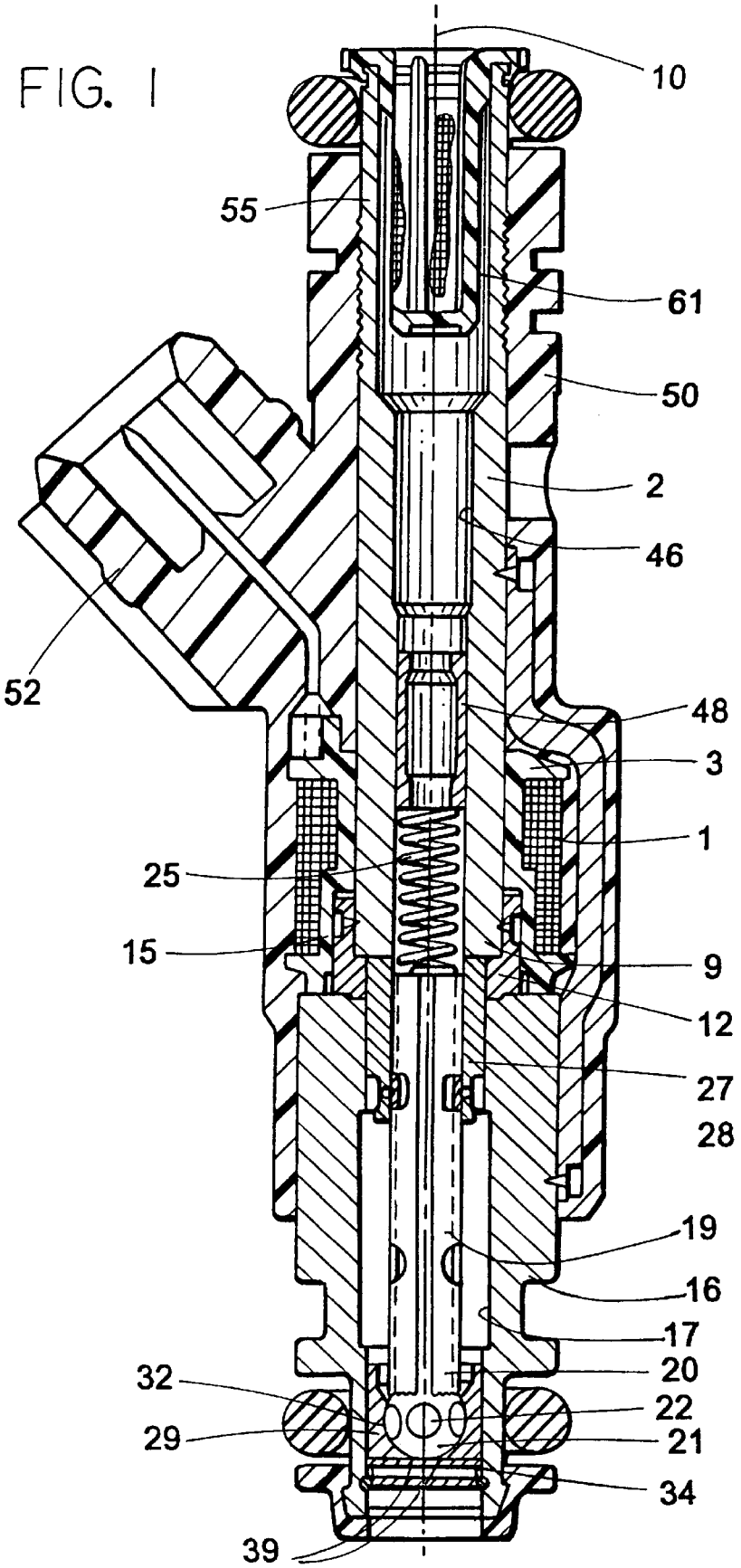
FIG. 1 shows a fuel injection valve according to the present invention.

The electromagnetically actuated valve shown as an example in FIG. 1, in the form of an injection valve for fuel injection systems of compressed-mixture, externally ignited internal combustion engines, has a core 2, serving as a fuel inlet nozzle, surrounded by a magnetic coil 1. Core 2 is tubular in shape, for example, and has a constant external diameter over its entire length. A bobbin 3 that is stepped in its radial direction carries the winding of magnetic coil 1 and, in conjunction with core 2, allows the injection valve to have a particularly compact design in the area of magnetic coil 1.

Concentrically with longitudinal valve axis 10, tubular metallic intermediary piece 12 is tightly connected to the lower end 9 of core 2, for example, by welding, and partially surrounds lower core end 9 axially. Stepped bobbin 3 partially surrounds core 2 and, with one step 15 having a larger diameter, intermediary piece 12, at least in part, axially. Downstream from bobbin 3 and intermediary piece 12, there is a tubular valve seat carrier 16, which is firmly connected to intermediary part 12, for example. A longitudinal bore hole 17 runs concentrically with longitudinal valve axis 10 in valve seat carrier 16. A valve needle 19, which is tubular, for example, and is connected, for example, by welding, at its downstream end 20 with a spherical valve closing body 21, on whose periphery five flats 22 are provided for the fuel to flow by, is arranged in longitudinal bore hole 17.

The injection valve is actuated electromagnetically in a known manner. The electromagnetic circuit with magnetic coil 1, core 2, and a socket-shaped armature 27 is used for axially moving valve needle 19 and thus for opening the injection valve against the elastic force of a restoring spring 25 and closing. Armature 27 is connected to valve needle 19 with its end facing away from valve closing body 21 through first welding seam 28 and aligned with core 2. At the downstream end facing away from core 2 of valve seat carrier 16, a cylindrical valve seat body 29, having a fixed valve seat, is tightly mounted in longitudinal bore hole 17 by welding.

A guide orifice 32 of valve seat body 29 is used to guide valve closing body 21 during the axial movement of valve needle 19 with armature 27 along longitudinal valve axis 10. Spherical valve closing body 21 works with the valve seat, which is conically tapered in the direction of the fuel flow, of valve seat body 29. At its end facing away from valve closing body 21, valve seat body 29 is concentrically and permanently attached to a perforated spray disk 34, which is pot-shaped, for example. At least one, but preferably four spray orifices 39, formed by eroding or punching, are located in the bottom part of perforated spray disk 34.

The insertion depth of valve seat body 29 with pot-shaped perforated spray disk 34 determines the setting of the stroke of valve needle 19. One end position of valve needle 19, when magnetic coil 1 is not energized, is determined by the contact of valve closing body 21 with the valve seat of valve seat body 29, while the other end position of valve needle 19, when magnetic coil 1 is energized, is determined by the contact of armature 27 with core end 9, i.e., exactly in the area designed according to the present invention, marked with a circle, and illustrated in FIG. 2 on a modified scale.

An adjusting socket 48, inserted in flow bore 46 of core 2 running concentrically with longitudinal valve axis 10, which is made of coiled spring steel sheets, for example, is used for prestressing restoring spring 25, which is in contact with adjusting socket 48 and whose opposite end is in contact with valve needle 19.

The injection valve is largely surrounded by extruded plastic coating 50, extending in the axial direction from core 2 through magnetic coil 1 to valve seat carrier 16. An electric connector 52, extruded together with plastic coating 50, is associated with this plastic coating 50.

A fuel filter 61 projects into flow bore 46 of core 2 at its intake end 55 and is responsible for filtering out fuel components that by their size could cause clogging or damage to the injection valve.

Figure 2:
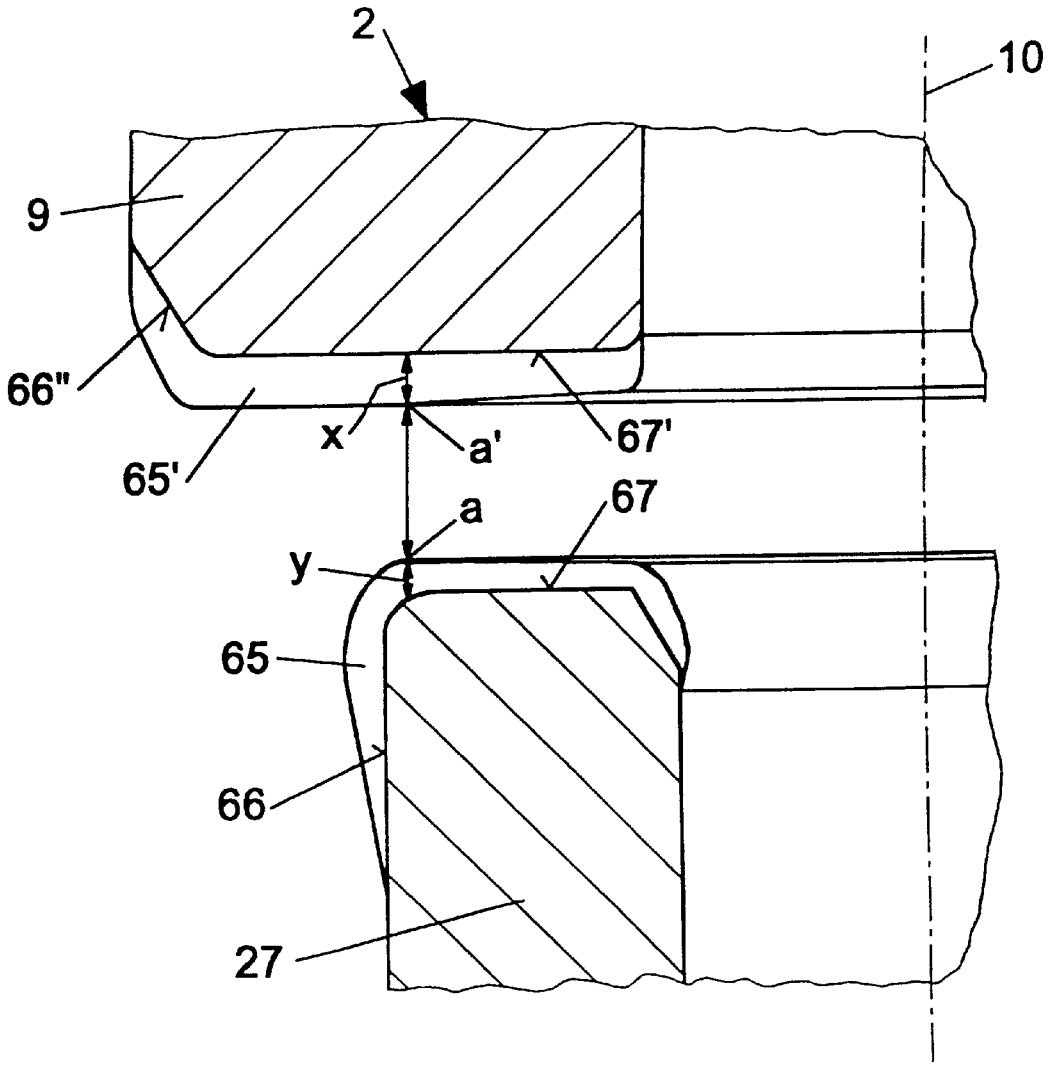
FIG. 2 shows a detail of the injection valve stop in the region of the core and armature provided with wear protection layers.

In FIG. 2, the area marked with a circle in FIG. 1 of one end position of valve needle 19, in which armature 27 is in contact with end 9 of core 2, is illustrated on a different scale. It is known that the metallic layers 65, for example of chromium or nickel, can be applied to end 9 of core 2 and to armature 27 by electroplating, for example. Layers 65 and 65' are applied both to end faces 67 and 67' running perpendicularly to longitudinal valve axis 10 and, at least partially, to peripheral surfaces 66 and 66' of armature 27 and core 2, respectively. Layers 65, which normally have a thickness between 10 and 25 $\mu$m, are shown in FIG. 2 with their layer thicknesses not to scale with respect to the size of components 2 and 27.

For the operation of the injection valve, core 2 and armature 27 must come into contact in a relatively small area, for example, only in the outer area of the upper face of armature 27, which faces away from longitudinal valve axis 10. This requirement is achieved through electroplating. In electroplating, a field line concentration resulting in a minimally tapered layer distribution, for example, occurs at the edges of the parts to be electroplated, here core 2 and armature 27. The layers applied, 65 and 65', are therefore stressed in small areas only during the operation of the injection valve.

The contact faces of the contact parts should maintain their dimensional accuracy to the maximum possible degree even after extended operation, so that the contact pickup and release time of armature 27 remains approximately constant despite some slight wear. The tolerances of the fuel amount to be injected $q_{dyn}$ can also be kept very narrow with a very high long-term stability of the area of this contact surface. Continuous operation tests show that the movable part, armature 27, is less subject to wear than the stationary part, core 2. The depth of wear of layers 65 and 65' resulting after many years of operation can be twice to three times as great on core 2 than on armature 27, for example. Therefore it makes sense that layer 65 on armature 27 be designed to be thinner in relation to layer 65' on core 2 without impairing long-term stability. Especially in the case of narrower tolerances, it is recommended that core 2 be provided with a layer 65' with a greater thickness x than that of armature 27.

As one example of possible layer thicknesses x and y for layers 65 and 65', we shall mention here 7 $\mu$m for core 2 and 4 $\mu$m for armature 27. These dimensions are, of course, always subject to narrow tolerances. These figures are being given for the sake of clarity only, without limiting the scope of the invention. In any case, layer thickness x of layer 65' of stationary core 2 is considerably greater than layer thickness y of layer 65 of axially movable armature 27, which means that layer thickness x of layer 65' of core 2 exceeds layer thickness y of layer 65 of armature 27 by at least 25%. These figures refer only to the immediate contact area a and a' on core 2 and armature 27, respectively, whose axial approximation area is marked with a double arrow.

Contact area a, a' is the actually wearing contact part, which has an annular shape in the ideal case and is usually sickle-shaped, i.e., has the shape of an annular section. Contact area a, a' usually has a contact width of 50 to 200 $\mu$m, with possible maximum widths of 300 $\mu$m. Outside contact area a, a', layers 65 and 65' can also be tapered, so that the opposite layer thicknesses are approximately the same. Usually layer 65 of armature 27 has, however, a smaller thickness y than thickness x of layer 65' on core 2; i.e., x>y, especially in the contact area a, a'. Chromium, molybdenum, nickel or carbon carbides are normally used as coating materials. Other coating materials normally used for coating can, however, also be used to manufacture wear-resistant layers 65, 65' on core 2 and armature 27.

What is claimed is:

1. An electromagnetically actuated fuel injection valve for a fuel injection system of an internal combustion engine, comprising:

a magnetic coil;

a core made of ferromagnetic material and surrounded by the magnetic coil with respect to a longitudinal axis of the core; and an armature aligned with respect to the core, the armature being axially movable along the longitudinal axis to cause a valve closing body to move out of a contacting relationship with respect to a fixed valve seat when a contact surface of the armature is attracted to an immediate contact area of a contact surface of the core in response to an energization of the magnetic coil, wherein:

the contact surface of the armature is provided with a first wear-resistant layer, and the contact surface of the core is provided with a second wear-resistant layer facing the first wear-resistant layer, the second wear-resistant layer having a layer thickness that is greater, at least in the immediate contact area, than a layer thickness of the first wear-resistant layer.

2. The valve according to claim 1, wherein the layer thickness of the second wear-resistant layer exceeds the layer thickness of the first wear-resistant layer in the immediate contact area by at least 25%.

3. The valve according to claim 1, wherein the layer thickness of the second wear-resistant layer is greater than the layer thickness of the first wear-resistant layer throughout a length of each one of the contact surface of the core and the contact surface of the armature.

4. The valve according to claim 1, wherein each one of the first wear-resistant layer and the second wear-resistant layer is tapered.

5. The valve according to claim 1, wherein a maximum width of the immediate contact area is 300 $\mu$m.

6. The valve according to claim 1, wherein each one of the first wear-resistant layer and the second wear-resistant layer is magnetic.

* * * * *